United States Patent [19]

Frei

[11] 4,025,061

[45] May 24, 1977

[54] APPARATUS FOR HEAT TREATMENT OF DISCRETE METALLIC COMMODITIES

[75] Inventor: Max Frei, Schonenwerd, Switzerland

[73] Assignee: Schenker Maschinen AG, Schonenwerd, Switzerland

[22] Filed: Apr. 28, 1976

[21] Appl. No.: 680,901

[30] Foreign Application Priority Data

May 5, 1975 Switzerland ..... 5735/75

[52] U.S. Cl. ..... 266/249

[51] Int. Cl.[2] ..... C21D 1/00

[58] Field of Search ..... 266/114, 121, 128–131, 266/133, 249, 251, 252, 254, 255, 257–261; 148/155; 214/21

[56] References Cited

UNITED STATES PATENTS

| | | | |
|---|---|---|---|
| 1,011,396 | 12/1911 | Abbott | 266/249 |
| 2,696,978 | 12/1954 | Siegel | 214/21 |
| 3,356,354 | 12/1967 | Beljaev et al. | 266/252 |

*Primary Examiner*—Gerald A. Dost
*Attorney, Agent, or Firm*—Peter K. Kontler; John Kurucz

[57] ABSTRACT

Apparatus for heating coil springs or other metallic commodities has a furnace defining a chamber for one or more upright cylindrical supports which form part of a conveyor system for moving an endless chain or band lengthwise so that successive holders of a series of equidistant holders for coil springs on the chain or band advance through the chamber. The chain or band is trained around the cylindrical support or supports in such a way that it forms at least one helix during travel through the chamber, and around one or more pulleys or sprocket wheels located outside of the chamber and being driven by a variable-speed motor. The helical configuration of the chain or band portion in the chamber of the furnace lengthens that portion of the path for the holders which is located in the chamber and thus prolongs the intervals of dwell of successive springs in the furnace.

17 Claims, 14 Drawing Figures

APPARATUS FOR HEAT TREATMENT OF DISCRETE METALLIC COMMODITIES

BACKGROUND OF THE INVENTION

The present invention relates to apparatus for conditioning discrete commodities, especially for heating metallic stock in a furnace. More particularly, the invention relates to improvements in apparatus wherein a conveyor system transports goods to be conditioned into, through and from at least one conditioning chamber or zone, e.g., into, through and from the interior of an annealing furnace for metallic springs or the like.

It is already known to heat metallic commodities in a furnace which is associated with a conveyor system including an endless belt or band which supports the commodities to be heated in random distribution. If the commodities are coil springs, their end convolutions are likely to become interlaced so that the freshly conditioned springs must be separated from each other in a time-consuming operation. The interlacing of randomly distributed coil springs presents additional problems if the springs are to be fed into an end grinder prior to further processing.

Attempts to insure an orderly transport of coil springs through the interior of a furnace include the provision of a conveyor system which employs two parallel wires spaced apart from each other by a distance less than the diameter of a coil spring. Thus, the springs can be placed onto the two wires in such a way that they form a single file of coaxial components during transport through the interior of the furnace. The wires are caused to pass through the furnace along a straight path. Those springs which issue from the furnace are ready to be introduced into or advanced past an end grinder. The loading of springs onto the two wires of the conveyor system can take place immediately at the discharge end of a coiling machine, i.e., successively formed springs are placed directly onto the conveyor system in the same orientation in which they issue from the maker. A drawback of the just described apparatus is that the wires advance through the furnace along a straight path. Therefore, if the springs are subjected to a longer-lasting heat treatment, the apparatus must include a relatively long and hence bulky and expensive furnace, and/or the conveyor system must be operated at an extremely low speed. If the furnace is short, the apparatus cannot be used for conditioning of different types of commodities unless the speed of the conveyor system is reduced to an economically unacceptable value. Furthermore, the furnaces which are associated with the two-wire conveyor system must have spaced-apart inlets and outlets for admission and evacuation of commodities, and this also contributes to the bulk and cost of the apparatus.

SUMMARY OF THE INVENTION

An object of the invention is to provide an apparatus for conditioning discrete commodities, especially for heating discrete metallic articles, which is more economical and more versatile than heretofore known apparatus.

Another object of the invention is to provide the apparatus with a novel and improved conveyor system for orderly transport of commodities through a conditioning zone, e.g., through the chamber of an annealing furnace for coil springs or the like.

A further object of the invention is to provide an apparatus which insures that discrete commodities are conditioned for periods of desired duration while employing a relatively small conditioning zone and while the commodities are transported at a relatively high speed.

An additional object of the invention is to provide an apparatus which is especially suited for heat treatment of coil springs or like resilient metallic elements and which can insure that the orientation of springs remains unchanged prior, during and subsequent to transport through the conditioning zone.

Still another object of the invention is to provide an apparatus which can employ a conventional furnace but insures a longer-lasting heating of discrete commodities than heretofore known apparatus.

A further object of the invention is to provide novel and improved means which can transport coil springs or analogous metallic elements through a furnace.

Another object of the invention is to provide the apparatus with novel and improved means for prolonging the periods of dwell of discrete commodities in the interior of a furnace.

The invention is embodied in a apparatus for conditioning discrete commodities, particularly for heating metallic stock (such as coil springs or torsion springs) in the chamber of a furnace. The apparatus comprises a furnace or other suitable means which defines a conditioning chamber wherein the temperature differs from the temperature of the surrounding atmosphere (the temperature in the chamber can be high enough to insure that the commodities to be transported through the chamber are annealed or subjected to another heat treatment), and means for transporting the commodities through the chamber. The transporting means includes first support means which is located in the chamber and may include one or more preferably upright cylindrical members which are held against rotation about their respective axes, second support means which is mounted outside of the chamber, an endless flexible element (e.g., a link chain or a steel band) which is trained around the first and second support means and has at least one pin, container or another suitable holder for commodities to be treated in the chamber, and means for moving the flexible element lengthwise so that the holder is advanced along an endless path, (such moving means may include a variable-speed prime mover which drives the flexible element through the medium of one of the support means, preferably by way of the second support means). At least one of the support means (preferably the first support means) comprises guide means (e.g., helical grooves or endless circumferential grooves in the aforementioned cylindrical member or members) which defines for the holder at least one inclined portion of the endless path for the holder or holders on the flexible element, such inclined portion being located at least in part in the chamber so that the interval of dwell of each commodity in the chamber is longer than the interval which would elapse if the path along which the holder or holders move through the chamber were a straight path. The lengthening of the interval is due to inclination of one or more portions of the path in the chamber as well as to the fact that the flexible element is trained around the first supply means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
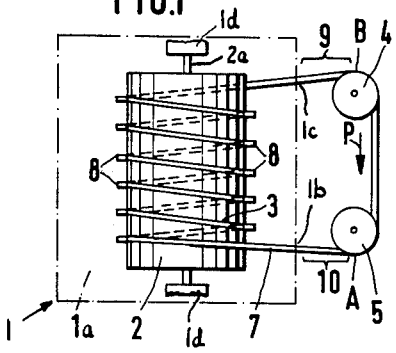
FIG. 1 is a schematic side elevational view of an apparatus which embodies one form of the invention.
Figure 2:
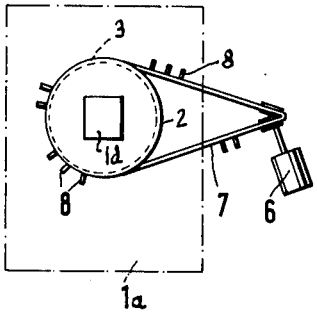
FIG. 2 is a schematic plan view of the apparatus.
Figure 10:
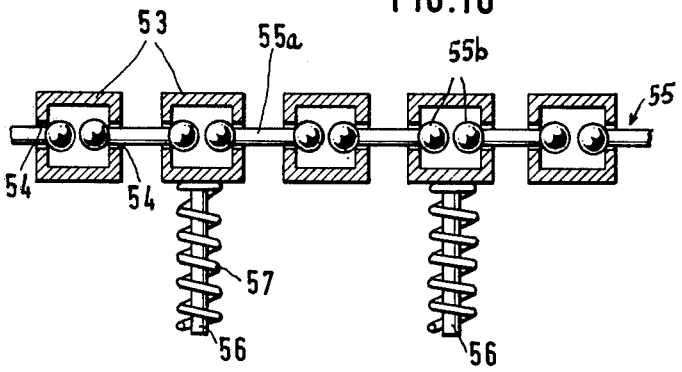
FIG. 10 is an enlarged fragmentary longitudinal sectional view of an endless flexible element which can be used in the apparatus of FIG. 1, 4 or 7.

Referring first to FIGS. 1 and 2, there is shown an apparatus for heating discrete commodities, e.g., helical coil springs 57 of the type shown in FIG. 10. The apparatus comprises a furnace 1 (indicated by phantom lines) which defines a heating or conditioning chamber or zone 1*a* with an inlet 1*b* and an outlet 1*c*. The chamber 1*a* accommodates an upright cylindrical support 2 (hereinafter called drum for short) whose shaft 2*a* is fixedly mounted in suitable bearing members 1*d* of the furnace 1 in such a way that the drum 2 is held against rotation about its axis. The periphery of the drum 2 is formed with a helical guide groove 3 (indicated in FIG. 2 by a broken-line circle).

The conveyor system of the apparatus which is shown in FIGS. 1 and 2 further comprises an endless flexible element or chain 7 (this chain may be of the type shown in FIG. 10, 11 or 12) which is trained around the drum 2 and around a second support including a driver pulley or sprocket wheel 5 and an idler pulley or sprocket wheel 4 in such a way that it extends into the helical groove 3. The lower pulley or sprocket wheel 5 is driven by a variable-speed electric motor 6 or another suitable prime mover. When the motor 6 is on, successive increments of the chain 7 enter the chamber 1*a* via inlet 1*b* and successive increments of the chain leave the chamber 1*a* via outlet 1*c*. The pulley or sprocket wheel 5 can be mounted directly on the output shaft of the motor 6 (especially if the latter is a variable-speed motor); alternatively, the transporting means or conveyor system may comprise a constant-speed motor which drives the pulley or sprocket wheel 5 through the medium of a variable-speed transmission, not shown.

The holder means for discrete commodities, such as coil springs 57, comprises pins or analogous projections 8 which are mounted on or made integral with the chain 7 and are preferably equally spaced apart from each other.

Figure 3:
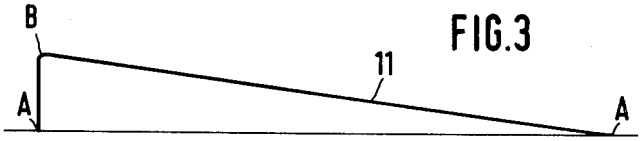
FIG. 3 is a developed view of the path along which the holders for discrete commodities move while advancing toward, through and from the interior of a furnace forming part of the apparatus shown in FIG. 1.

When the motor 6 rotates the pulley or sprocket wheel 5 to advance the chain 7 lengthwise in the direction indicated by arrow P, successive holders 8 can receive discrete coil springs during travel past a loading or charging station 10 intermediate the member 5 and the inlet 1*b*. Conditioned springs can be removed from the chain 7 at an unloading or removing station 9 between the outlet 1*c* and the pulley or sprocket wheel 4. Due to helical configuration of the guide groove 3 in the periphery of the drum 2, the path of successive commodities resembles the path 11 which is shown in developed view in FIG. 3. Thus, any given increment of the chain 7 travels from the point A at the periphery of the driver pulley or sprocket wheel 5 toward a point B at the periphery of the pulley or sprocket wheel 4, and thereupon back toward the point A. The path portion between the points A and B (as considered in the direction indicated by arrow P) is inclined because the lowermost point of the groove 3 can be located at a level above or below the point A, because the chain 3 thereupon moves along the helical groove 3, and because the uppermost point of the groove 3 can be located at a level above or below the point B. The path portion between B and A may but need not be exactly vertical. It will be noted that the axes of the pulleys or sprocket wheels 4, 5 are preferably inclined with respect to each other. The major part of the path portion between the points A and B extends through the chamber 1*a* of the furnace 1 so that each commodity is conditioned for a relatively long interval of time, even if the motor 6 drives the chain 3 at a relatively high speed. Moreover, the loading and unloading stations 10, 9 are located at the same side of the furnace 1 which contributes to compactness of the apparatus. The length of the intervals of dwell of commodities in the chamber 1*a* can be increased or reduced by changing the number of convolutions of the groove 3, by changing the diameter of the drum 2, and/or by changing the speed of the motor 6. The drum 2 may but need not be an upright cylinder; for example, the improved apparatus can employ a drum having a polygonal or oval cross-sectional outline.

The points A and B are located at different levels, and the portion 11 of the endless path for the holders 8 slopes continuously from the level of the point A to the point B, i.e., the holders move upwardly during travel from the lowermost point of the member 5 toward the uppermost point of the member 4.

Figure 4:
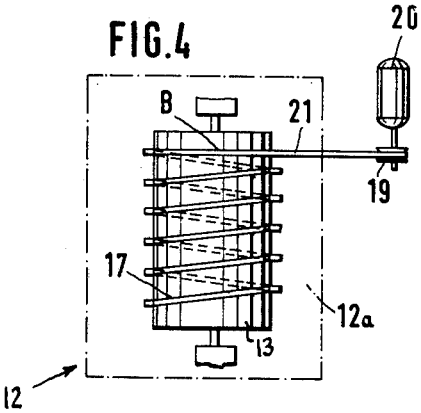
FIG. 4 is a schematic side elevational view of a second apparatus.
Figure 5:
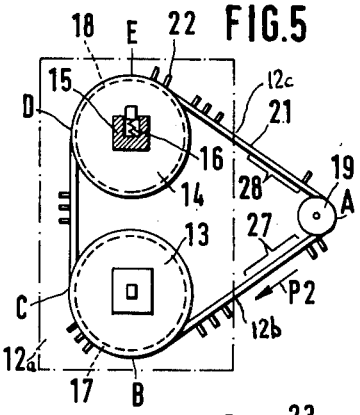
FIG. 5 is a schematic plan view of the second apparatus.

FIGS. 4 and 5 illustrate a modified apparatus which includes a furnace 12 having a heating or conditioning chamber 12*a* with an inlet 12*b* and an outlet 12*c*. The chamber 12*a* accommodates two upright cylindrical supports (hereinafter called drums) 13 and 14 whose axes are parallel to each other. Neither of the drums 13, 14 rotates about its axis; however, the end portions of the shaft of the drum 14 are mounted in special bearings 15 (one shown in FIG. 5) which include coil springs 16 or analogous means for yieldably urging the drum 14 away from the drum 13, i.e., upwardly, as viewed in FIG. 5. The bearings 15 have slots which allow the shaft of the drum 14 to move toward or away from the drum 13. The peripheral surfaces of the drums 13, 14 are respectively formed with helical guide grooves 17, 18 which are inclined in opposite directions.

Figure 6:
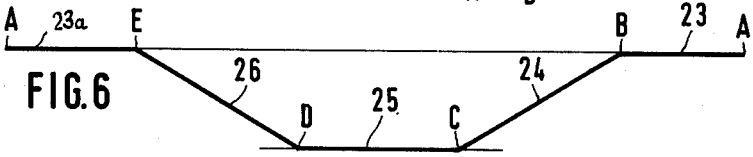
FIG. 6 is a developed view of the path along which the holders on the flexible element of the second apparatus move while advancing toward, through and from the furnace of the apparatus shown in FIG. 4.

The conveyor system or transporting means of the apparatus of FIGS. 4 and 5 comprises an endless flexible element or chain 21 which is trained around the drums 13, 14 (so that it is guided by the grooves 17, 18) and around a further support here shown as a pulley or sprocket wheel 19 which is mounted outside of the chamber 12*a* and is driven by a variable-speed motor 20 or another suitable prime mover (e.g., a prime mover including a constant-speed electric motor and a variable-speed transmission). The chain 21 is formed with equally spaced pin-shaped holders 22 for commodities (e.g., coil springs) which are to be treated in the chamber 12*a*. When the motor 20 drives the pulley or sprocket wheel 19 so as to move the chain 21 lengthwise in the direction indicated by arrow P2, successive holders 22 travel from a point A at the periphery of the member 19 past a charging or loading station 27 where the holders receive discrete coil springs, thereupon to a point B at the upper end of the guide groove 17 in the periphery of the drum 13, thereupon to a point C at the lower end of the groove 17, thereupon to a point D at the lower end of the guide groove 18, thereupon to a point E at the upper end of the groove 18, and finally back to the point A whereby the holders 22 move past an unloading or removing station 28 for conditioned commodities. As shown in FIG. 6, the portions 23, 23*a* and 25 of the endless path for the holders 22 of the chain 21 are horizontal but are located at different levels, and the portions 24, 26 are inclined. The path portions 24, 25 and 26 are located entirely within the chamber 12*a*, and the portions 23, 23*a* are located partly within the chamber. The portions 23 and 23*a* are but need not be located at the same level. The portions 24, 26 correspond to the path portions which are defined by the helical guide grooves 17, 18 of the drums 13, 14.

It will be noted that the overall length of the path portion which extends through the chamber 12*a* constitutes by far the major part of the entire path for the holders 22 so that each commodity can be conditioned for a relatively long interval of time even if the motor 20 drives the chain 21 at a high speed. The interval can be lengthened or shortened by changing the speed of the motor 20.

When the chain 21 passes through the chamber 12*a*, it expands as a result of heating. In order to insure that the chain remains in the guide grooves 17 and 18 of the drums 13, 14, the springs 16 bias the drum 14 away from the drum 13 so as to maintain the chain under requisite tension. When the furnace 12 is idle, the length of the chain 21 decreases and the springs 16 yield to allow the drum 14 to move nearer to the drum 13.

The holders 22 which travel past the station 27 can receive coil springs directly from a maker, and the springs which reach the station 28 can be transferred into an end grinding machine or to a further conveyor system for transport to the next processing station.

Figure 7:
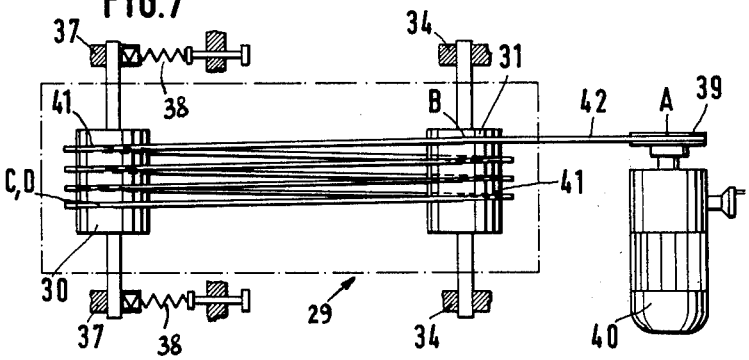
FIG. 7 is a schematic side elevational view of a third apparatus.
Figure 8:
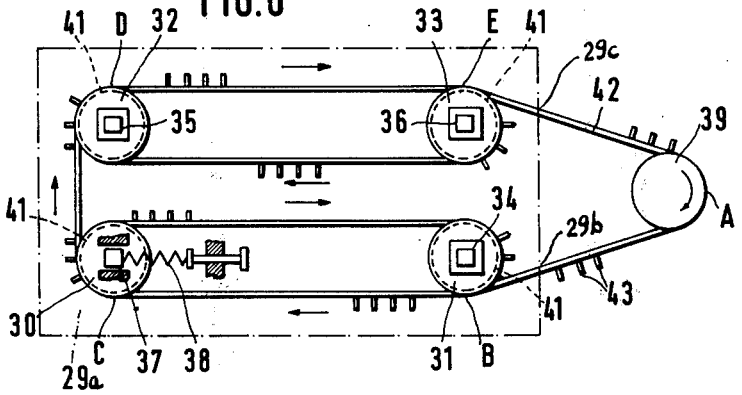
FIG. 8 is a schematic plan view of the third apparatus.
Figure 9:
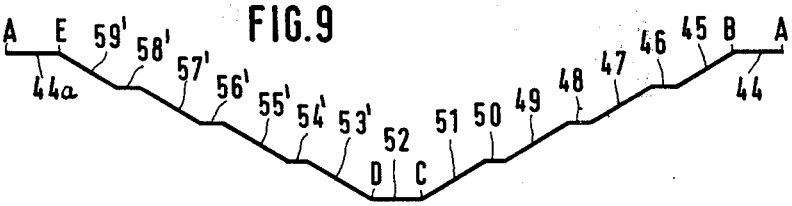
FIG. 9 is a developed view of the path along which the holders on the flexible element move on their way toward, through and from the furnace of the apparatus shown in FIG. 7.

FIGS. 7 and 8 illustrate a third apparatus which includes a furnace 29 defining a chamber 29*a* with an inlet 29*b* and an outlet 29*c*. The chamber 29*a* accommodates four upright cylindrical supports or drums 30, 31, 32 and 33 which are mounted in bearings 37, 34, 35, 36 of the furnace 29 so that they cannot rotate about their respective axes. The bearings 37 for the drum 30 include helical springs 38 or analogous compensating means which yieldably urge the drum 30 away from the drum 31 so as to maintain under constant tension an endless flexible element or chain 42 which is trained around the four drums and around a further support here shown as a pulley or sprocket wheel 39 driven by a variable-speed prime mover 40. The drums 30–33 have discrete endless peripheral grooves 41 which guide the adjacent portions of the chain 42. The latter has equally spaced holders 43 for coil springs or analogous commodities which are to be treated in the chamber 29*a*. The chain 42 has a horizontal portion or stretch 44 which extends from a point A at the periphery of the pulley or sprocket wheel 39 to a point B of the uppermost endless groove 41 in the periphery of the drum 31. The portion 44 is followed by a downwardly inclined portion 45 which extends from the uppermost groove 41 of the drum 31 to the uppermost groove 41 in the periphery of the drum 30, a horizontal third portion 46 which is defined by one-half of the uppermost groove 41 of the drum 30, a downwardly inclined portion 47 between the uppermost groove 41 of 30 to the next-to-the-uppermost or median groove 41 of 31, a horizontal portion 48 defined by one-half of the median groove 41 of 31, a downwardly inclined portion 49 extending from the just mentioned groove to the next-to-the-uppermost groove 41 of 30, a horizontal portion 50 defined by the next-to-the-uppermost groove of 30, and so forth. The portion 51 of FIG. 9 is inclined downwardly and extends from the lowermost groove 41 of 31 to the lowermost groove of 30. This portion is followed by a horizontal portion 52 extending from the point C of the lowermost groove 41 of 30 to the point D of the lowermost groove 41 of 32 (the portion 52 is defined in part by the lowermost grooves 41 of the drums 30 and 32). The upwardly inclined portion 53' extends from the lowermost groove 41 of 32 to the lowermost groove of 33 and is followed by a horizontal portion 54' defined by the right-hand half of the lowermost groove of 33. The upwardly inclined portion 55' extends from the lowermost groove 41 of 33 to the next-to-the-lowermost groove 41 of 32, and the horizontal portion 56' is defined by the left-hand half of the next-to-the-lowermost groove 41 of 32. The upwardly inclined portion 57' extends from the next-to-the-lowermost groove 41 of 32 to the next-to-the-lowermost groove 41 of 33, and the horizontal portion 58' is defined by the right-hand portion of the next-to-the-lowermost groove 41 of 33. The upwardly inclined portion 59' extends from the uppermost groove 41 to the uppermost groove 41 of 33, and the horizontal portion 44*a* extends from the point E defined by the uppermost groove 41 of 33 to the point A of the pulley or sprocket wheel 39. It will be noted that the holders 43 of the chain 42 travel along an endless path which includes alternating horizontal and inclined portions whereby the portions 45, 47, 49, 51 are inclined downwardly and the portions 53', 55', 57', 59' are inclined upwardly. The inclined portions of the path develop as a result of staggering of grooves 41 in the peripheries of drums 31 and 33 relative to the grooves 41 of drums 30 and 32, as considered in the axial direction of such drums. The horizontal portions of the path are defined by portions of the grooves 41 and also due to the fact that the lowermost grooves 41 of the drums 30, 32 are located at the same level as well as that the uppermost grooves of the drums 33, 31 are located at the same level which, of course, is different from the level of the lowermost grooves of 30 and 32.

An advantage of the apparatus of FIGS. 7 and 8 is that the intervals of dwell of commodities in the chamber 29*a* can be prolonged still further even if the dimensions of the furnace 29 do not exceed those of the furnace 1 or 12, and provided that the speed of the chain 42 is the same as that of the chain 7 or 21. This is due to the fact that the length of the portion of the path shown in FIG. 9 which extends through the chamber 29*a* greatly exceeds the length of the corresponding portion of the path shown in FIG. 3 or 6. In order to reduce friction, the chain 42, 7 and/or 21 can be provided with roller followers (not shown) which rotate during engagement with the surfaces bounding the grooves of the respective drums and pulleys or sprocket wheels.

FIG. 10 shows a portion of an endless flexible element or chain which can be utilized in the apparatus of FIG. 1, 4 or 7. The chain comprises hollow cylindrical, spherical or otherwise configurated sockets 53 which are coupled to each other by rod-shaped links 55. Each socket 53 has two aligned openings 54 having diameters exceeding the diameters of shanks 55*a* of the respective links 55. Each link 55 has two spherical end portions 55*b* whose diameters exceed the diameters of the respective openings 54 and which are received in the neighboring sockets 53. This enables the links 55 to move in all directions to the extent which is determined by differences between the diameters of the shanks 55*a* and openings 54. The sockets 53 carry pin-shaped holders or fingers 56 for discrete coil springs 57, e.g., helical coil springs. The inclination of holders 56 is such that the springs 57 are retained thereon during transport through the chamber of the respective furnace.

Figure 11:
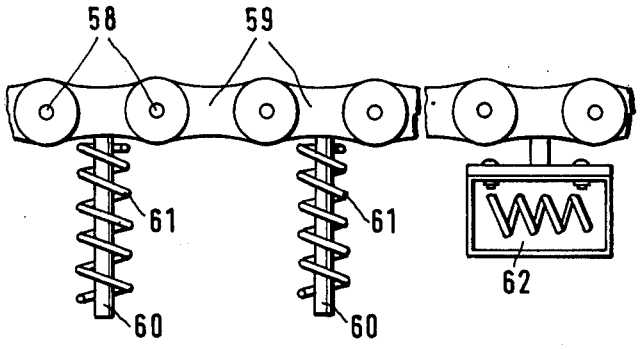
FIG. 11 is a fragmentary side elevational view of a second endless flexible element.

The endless flexible element of FIG. 11 is a simple link chain having links 59 which are coupled to each other by shafts 58. The links 59 carry pin-shaped holders 60 for helical coil springs 61. Alternatively, the holders may assume the form of receptacles 62 (one shown in FIG. 11) which have compartments for reception of discrete helical coil springs or other commodities which are to be conditioned during transport through the chamber of a heating furnace.

Figure 12:
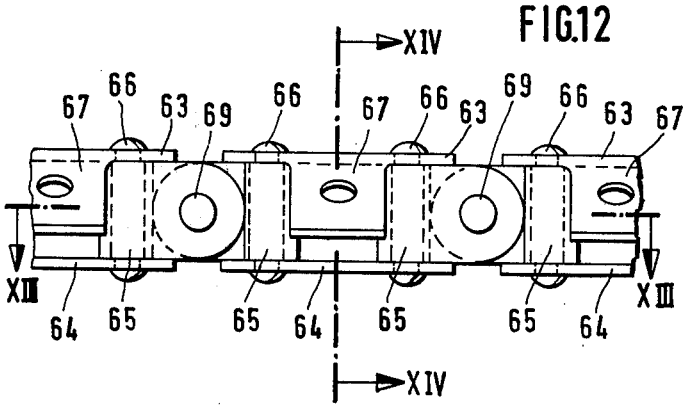
FIG. 12 is a fragmentary side elevational view of a third endless flexible element.
Figure 13:
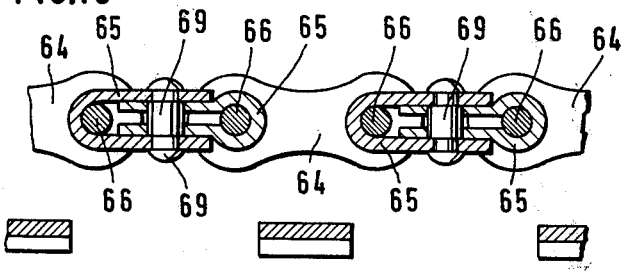
FIG. 13 is a sectional view as seen in the direction of arrows from the line XIII—XIII of FIG. 12.
Figure 14:
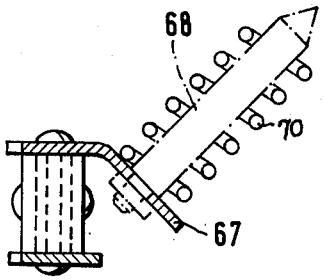
FIG. 14 is a sectional view as seen in the direction of arrows from the line XIV—XIV of FIG. 12.

The endless flexible element or chain of FIGS. 12 to 14 comprises links 63, 64 which may constitute or comprise holders for helical coil springs 70. The links 63, 64 are held apart by distancing members 65 mounted on shafts 66. The ends of the shafts 66 are enlarged to form rivet heads. Each link 63 has a downwardly inclined lug or plate 67 which carries a pin or post 68 constituting the actual holder for a spring 70. The distancing members 65 are U-shaped bodies whose flanges are telescoped into each other (see particularly FIG. 13) and are pivotably secured to each other by rivets 69 whose axes are normal to those of the shafts 66. This enables the chain to articulate in two planes which are normal to each other.

It is further within the purview of the invention to replace the chain of FIG. 10, 11 or 12 with an endless flexible element in the form of a cable or band (e.g., a steel band) which is provided with equally spaced holders for commodities to be treated during transport through the furnace.

The apparatus of the present invention can be used for annealing, normalizing, tempering, patenting, precipitation hardening, case hardening (nitriding, carburizing or cyaniding) or other heat treatment of discrete metallic commodities. It is further within the purview of the invention to use the apparatus for cooling of discrete commodities, i.e., for transporting commodities to be treated through a cooling (e.g., quenching) chamber.

The materials of the furnace and of the component parts of transporting means are selected with a view to stand the temperatures in the chamber of the furnace as well as to stand the normally pronounced differences between the temperature in the furnace and the temperature in the surrounding atmosphere.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for conditioning discrete commodities, particularly for heating metallic stock in the chamber of a furnace, comprising means defining a conditioning chamber wherein the temperature differs from the temperature of the surrounding atmosphere; and means for transporting commodities through said chamber, including first support means in said chamber, second support means outside of said chamber, an endless flexible element trained around said first and second support means and having at least one holder for commodities to be conditioned in said chamber, and means for moving said flexible element lengthwise so that said holder advances along an endless path, said moving means comprising a variable-speed prime mover and said first support means having guide means defining at least one inclined portion of said path within said chamber, said flexible element having at least one helical portion which is formed by said guide means and is located in said chamber.

2. Apparatus as defined in claim 1, wherein said chamber defining means is a furnace and the temperature in said chamber exceeds the temperature of the surrounding atmosphere, said chamber having an inlet and an outlet for said flexible element.

3. Apparatus as defined in claim 1, wherein said prime mover drives said flexible element through the medium of said second support means.

4. Apparatus as defined in claim 3, wherein said second support means comprises at least one rotary member which is rotated by said prime mover.

5. Apparatus as defined in claim 1, wherein said flexible element comprises a plurality of substantially equally spaced holders for discrete commodities.

6. Apparatus as defined in claim 5, wherein said flexible element is a chain.

7. Apparatus as defined in claim 5, wherein said flexible element is a band.

8. Apparatus for conditioning discrete commodities, particularly for heating metallic stock in the chamber of a furnace, comprising means defining a conditioning chamber wherein the temperature differs from the temperature of the surrounding atmosphere; and means for transporting commodities through said chamber, including first support means in said chamber, second support means outside of said chamber, an endless flexible element trained around said first and second support means and having at least one holder for commodities to be conditioned in said chamber, and means for moving said flexible element lengthwise so that said holder advances along an endless path, at least one of said support means having guide means defining at least one inclined portion of said path within said chamber, said support means and said guide means defining for said holder an endless path having a first portion located at a first level, a spaced-apart second portion located at a second level, a first inclined portion extending from said first level to said second level, and a second inclined portion extending from said second level to said first level, as considered in the direction of lengthwise movement of said flexible element.

9. Apparatus as defined in claim 8, wherein said inclined portions and one of said first and second portions of said path are located in said chamber.

10. Apparatus for conditioning discrete commodities, particularly for heating metallic stock in the chamber of a furnace, comprising means defining a conditioning chamber wherein the temperature differs from the temperature of the surrounding atmosphere; and means for transporting commodities through said chamber, including first support means in said chamber, second support means outside of said chamber, an endless flexible element trained around said first and second support means and having at least one holder for commodities to be conditioned in said chamber, and means for moving said flexible element lengthwise so that said holder advances along an endless path, at least one of said support means having guide means defining at least one helical portion of said path within said chamber.

11. Apparatus for conditioning discrete commodities, particularly for heating metallic stock in the chamber of a furnace, comprising means defining a conditioning chamber wherein the temperature differs from the temperature of the surrounding atmosphere; and means for transporting commodities through said chamber, including first support means in said chamber, second support means outside of said chamber, an endless flexible element trained around said first and second support means and having at least one holder for commodities to be conditioned in said chamber, and means for moving said flexible element lengthwise so that said holder advances along an endless path, said first support means having a helical groove defining at least one inclined portion of said path within said chamber.

12. Apparatus as defined in claim 11, wherein said first support means comprises at least one cylindrical member and said groove is provided in the periphery of said cylindrical member.

13. Apparatus for conditioning discrete commodities, particularly for heating metallic stock in the chamber of a furnace, comprising means defining a conditioning chamber wherein the temperature differs from the temperature of the surrounding atmosphere; and means for transporting commodities through said chamber, including first support means in said chamber, second support means outside of said chamber, an endless flexible element trained around said first and second support means and having at least one holder for commodities to be conditioned in said chamber, and means for moving said flexible element lengthwise so that said holder advances along an endless path, said first support means having guide means defining for the path of said holder a plurality of inclined portions alternating with substantially horizontal portions of said path within said chamber.

14. Apparatus as defined in claim 13, wherein said horizontal portions of said path include an uppermost portion and a lowermost portion and all of said inclined portions slope in a direction from said uppermost to said lowermost horizontal portion.

15. Apparatus as defined in claim 13, wherein said horizontal portions of said path include an uppermost portion and a lowermost portion, said inclined portions including a first group whose portions slope downwardly from said uppermost portion toward said lowermost portion and a second group whose portions slope upwardly from said lowermost portion toward said uppermost portion, as considered in the direction of lengthwise movement of said flexible element.

16. Apparatus for conditioning discrete commodities, particularly for heating metallic stock in the chamber of a furnace, comprising means defining a conditioning chamber wherein the temperature differs from the temperature of the surrounding atmosphere; and means for transporting commodities through said chamber, including first support means in said chamber, second support means outside of said chamber, an endless flexible element trained around said first and second support means and having at least one holder for commodities to be conditioned in said chamber, and means for moving said flexible element lengthwise so that said holder advances along an endless path, said first support means comprising at least two upright cylindrical members having endless peripheral grooves constituting guide means defining at least one inclined portion of said path within said chamber, at least some grooves of one of said members being located at levels different from the levels of grooves of the other of said members and said flexible element being coiled around said members and having inclined portions extending from the grooves of one of said members to the grooves of the other of said members.

17. Apparatus as defined in claim 16, wherein said grooves are disposed in substantially horizontal planes.

* * * * *